US006723684B2

(12) United States Patent
Akiyama et al.

(10) Patent No.: US 6,723,684 B2
(45) Date of Patent: Apr. 20, 2004

(54) LOW TORQUE GREASE COMPOSITION

(75) Inventors: Motoharu Akiyama, Nagano-ken (JP); Tatsuya Hashimoto, Tokyo (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 10/336,410

(22) Filed: Jan. 3, 2003

(65) Prior Publication Data

US 2003/0148896 A1 Aug. 7, 2003

(30) Foreign Application Priority Data

Jan. 15, 2002 (JP) ..... 2002-006792

(51) Int. Cl.[7] ..... C10M 169/02
(52) U.S. Cl. ..... 508/182; 508/582
(58) Field of Search ..... 508/182, 582

(56) References Cited

U.S. PATENT DOCUMENTS 4,472,290 A * 9/1984 Caporiccio et al. ..... 508/181
4,724,092 A * 2/1988 Fukui et al. ..... 508/182
4,985,161 A * 1/1991 Tohzuka et al. ..... 508/182
5,518,639 A * 5/1996 Luk et al. ..... 508/116
6,025,307 A * 2/2000 Chittofrati et al. ..... 508/182
6,329,326 B1 * 12/2001 Iso et al. ..... 508/182

FOREIGN PATENT DOCUMENTS

| | | |
|---|---|---|
| EP | 0 856 570 | 8/1988 |
| JP | 7-102274 | 4/1995 |

* cited by examiner

*Primary Examiner*—Jacqueline V. Howard
(74) *Attorney, Agent, or Firm*—Flynn Thiel, Boutell & Tanis, P.C.

(57) ABSTRACT

There is provided a grease composition useful for bearings of cars and aircraft which is stable in a wide range of temperature of 40 to 180° C. and exhibits low torque properties under high loading at low temperatures. A low torque grease composition having dynamic viscosity (40° C.) of 40 to 150 $mm^2$/sec which comprises a base oil consisting of (a) straight-chain perfluoropolyether oil having dynamic viscosity (40° C.) of 25 $mm^2$/sec or less and represented by the following general formula: $RfO(CF_2O)_p(C_2F_4O)_q(C_3F_6O)_rRf$, wherein Rf is a perfluoro lower alkyl group and all of p, q and r is an integer and a sum thereof is an integer of 25 to 45 and (b) straight-chain perfluoropolyether oil having dynamic viscosity (40° C.) of 250 $mm^2$/sec or more and represented by the following general formula: $RfO(CF_2O)_p(C_2F_4O)_q(C_3F_6O)_rRf$, wherein Rf is a perfluoro lower alkyl group and p, q and r are an integer of 10 to 20; and (c) polytetrafluoroethylene as a thickener.

16 Claims, No Drawings

LOW TORQUE GREASE COMPOSITION

This application claims all rights of priority to Japanese Patent Application No. 2002-006792 filed on Jan. 15, 2002, (pending).

BACKGROUND OF THE INVENTION

1. Field of the Invention

This invention relates to a low torque grease composition, and more particularly relates to a low torque grease composition comprising perfluoropolyether oil as a base oil and polytetrafluoroethylene as a thickener, and a motor bearing for cars or aircraft to which such a composition is applied. Further, this invention relates to a bearing grease composition for electric controlling throttle motors, and more particularly relates to a fluorine grease composition of improved properties exhibiting low torque at low temperatures, long durability and effective applicability at low and high temperatures when the present grease is filled in a bearing.

2. Prior Art

Grease to be injected in a motor bearing for cars and aircraft is required to have constant properties in a wide range of temperatures postulated in the severely cold polar regions and the broiling deserts ranging from −40 to 180° C.

Although a variety of investigations have been done to satisfy such properties, in fact, there is yet room for further improvement thereof.

Requirements for a bearing grease composition used to cars and, in particular, electric controlling throttle motors include low torque, i.e., low rotational torque at room temperature and low temperatures, high acoustical properties, less leakage or volatility, long durability, and effective applicability in a wide range of low to high temperatures ranging from −40 to 180° C. Especially for bearings of severe requirements, there is used fluorine grease of high properties such as improved high-temperature durability, oxidative stability and chemical resistance or outstanding low-temperature performance.

Conventional fluorine grease comprises perfluoropolyether as a base oil, tetrafluoroethylene copolymer as a thickener and a small amount of other components such as a rust preventing agent or corrosion inhibitor. When further low-temperature performance is required, a straight-chain perfluoropolyether oil having low-temperature performance is used.

Because of recent strong requirements, it is impossible for such fluorine grease to satisfy a required level of resistance to low-temperature torque under load and durability. In order to meet such severer requirements, there is proposed a grease composition by Japanese Patent No. 7-102,274, which comprises a liquid fluorinated polymer and a hexagonal boron nitride powder of double-humped particle size distribution. The proposed grease composition has excellent heat resistance and bearing durability, while there is no disclosure with regard to low-temperature torque properties.

DETAILED DESCRIPTION

The inventors have eagerly investigated to develop a grease composition useful for bearings of cars and aircraft which is stable in a wide range of temperature of 40 to 180° C. and exhibits low torque properties under high loading at low temperatures. As a result, there are provided a grease composition of markedly lower torque compared with those conventional grease compositions comprising perfluoropolyether oil as a base oil and a low torque grease composition useful for motor bearings of cars and, in particular, of electric controlling throttle motor, or for those bearings of aircraft.

Further, the inventors have investigated to develop a fluorine grease composition of low torque and long durability under a condition of high load and low temperatures useful for rolling bearings, which meets requirements of bearings for electric controlling throttle motor.

SUMMARY OF THE INVENTION

It has been found that objects of the invention can be achieved by using a perfluoropolyether oil as a base oil limited only to a straight-chain polymer excluding branched one as a polymer compound of both high and low molecular weight, and a polytetrafluoroethylene fine powder as a thickener. This invention has been developed on the basis the above mentioned fact.

More concretely, a low torque grease composition having dynamic viscosity (40° C.) of 40 to 150 $mm^2$/sec and stability in a wide range of temperature ranging from −40 to 180° C. can be obtained by using a base oil consisting of (a) straight-chain perfluoropolyether oil having dynamic viscosity (40° C.) of 25 $mm^2$/sec or less and represented by the following general formula:

$$RfO(CF_2O)_p(C_2F_4O)_q(C_3F_6O)_rRf$$

wherein Rf is a perfluoro lower alkyl group and p, q and r are 0 or an integer less than 10, and (b) straight-chain perfluoropolyether oil having dynamic viscosity (40° C.) of 250 $mm^2$/sec or more and represented by the following general formula:

$$RfO(CF_2O)_p(C_2F_4O)_q(C_3F_6O)_rRf$$

wherein Rf is a perfluoro lower alkyl group and p, q and r are 0 or an integer of 10 to 200; and (c) polytetrafluoroethylene as a thickener.

THE PREFERRED EMBODIMENTS

A straight-chain perfluoropolyether oil used in the invention is represented by the following general formula:

$$RfO(CF_2O)_p(C_2F_4O)_q(C_3F_6O)_rRf$$

wherein Rf is a perfluoro lower alkyl group and p, q and r are an integer of 200 or less; and preferably a straight-chain perfluoropolyether oil of the above mentioned molecular structure wherein r=0.

The reason why a straight-chain perfluoropolyether oil comprising a group of chemical formula $(C_3F_6O)_r$ causes to increase the viscosity and thus the torque at low temperatures is because of lower viscosity index thereof compared with that of a straight-chain perfluoropolyether oil without the group $(C_3F_6O)_r$. Accordingly, the torque at lower temperatures can be further decreased by using the above mentioned straight-chain perflouoropolyether of the molecular formula wherein r=0. More concretely, the following compound is used:

$$RfO(CF_2CF_2O)_m(CF_2O)_nRf$$

wherein m+n=3 to 200 and m/n=10/90 to 90/10. This compound is obtained by photo-oxidative polymerization of tetrafluoroethylene followed by complete fluorination of thus polymerized precursor.

A straight-chain perfluoropolyether oil as a component (a) used herein has lower molecular weight and dynamic viscosity (40° C.) of 25 $mm^2$/sec or less, and preferably 5 to 25 $mm^2$/sec (according to JIS K-2283; −40° C.). When the dynamic viscosity (40° C.) is lower than the above mentioned level, it is impossible to use such a component (a) to heat resistant grease because of an increase in evaporation loss.

A straight-chain perfluoropolyether oil as a component (b) to be mixed with the component (a) has higher molecular weight and dynamic viscosity (40° C.) of 250 $mm^2$/sec or more, and preferably 250 to 500 $mm^2$/sec (according to JIS K-2283; −40° C.). The component (b) having dynamic viscosity (40° C.) higher than the above mentioned level causes an increase in torque at low temperatures if the grease is used in a general manner because of higher pour point thereof (JIS K-2283).

These perfluoropolyether oils of different viscosity have different properties each other. The perfluoropolyether oil (a) exhibits higher viscosity index, lower torque properties and lower abrasion resistance, although the heat resistance is not so good. On the other hand, the perfluoropolyether oil (b) exhibits lower volatility and improved oil film keeping properties at high temperatures, although the torque properties at low temperatures are not so good.

These straight-chain perfluoropolyether oils having different molecular weight and viscosity are mixed so that prominent properties of both components (a) and (b) can be retained in the thus formed base oil, thereby durability being exhibited together with torque properties at low temperatures. The base oil can be endowed with abrasion resistance and durability while retaining low temperature torque properties of the perfluoropolyether oil (a) by properly mixing it with the perfluoropolyether oil (b). A mixing rate of perfluoropolyether oils (a) and (b) may be variable depending on a condition to be applied, but is preferably 90/10 to 10/90.

It is surprising in view of the fact that a grease composition of higher torque is unexpectedly yielded when the base oil comprises only a straight-chain perfluoropolyether oil having intermediate molecular weight between both low and high molecular weight of components (a) and (b).

However, it is possible to some extent to obtain a low torque grease composition of the invention when such a straight-chain perfluoropolyether oil of intermediate molecular weight exists in the base oil in an amount of about 20% by mass or less of total weight thereof.

Polytetrafluoroethylene as a thickener (c) is prepared by copolymerizing tetrafluoroethylene in the presence of a molecular weight modifier to form a telomer which melting point is limited within the range of 310 to 330° C. Tetrafluoroethylene is polymerized by, for example, solution polymerization, emulsion polymerization or suspension polymerization to form polytetrafluoroethylene having high molecular weight, i.e., number-average molecular weight of about 1000 to 500,000, which is then treated by thermal decomposition, r-ray irradiation, mechanical grinding, etc. The thus obtained polytetrafluoroethylene has an average primary particle diameter of 500 μm or less, in general, and preferably about 0.05 to 20 μm.

Polytetraethylene as a thickener (c) desirably comprises combined particles of larger and smaller particle diameters.

The thickener (c) preferably comprises (d) particulate component having a particle diameter of 0.5 μm or less in an amount of 5 to 95% by mass and (e) particulate component having a particle diameter of 5 μm or more in an amount of 95 to 5% by mass.

The particulate component (d) having a particle diameter of 0.5 μm or less includes emulsion polymerized polytetrafluoroethylene having molecular weight of 100,000 to 200,000 and a primary particle diameter of 0.2 μm, or solution polymerized one having molecular weight of 100,000 to 200,000 and a primary particle diameter of 0.1 μm.

The particulate component (e) having a particle diameter of 5 μm or more includes polymerized polytetrafluoroethylene.

Such polytetrafluoroethylene as a thickener is compounded to the grease composition in an amount of 1 to 60%, and preferably 5 to 30% by mass of the total composition.

The low torque grease composition of the invention may further comprise a rust preventing agent or corrosion inhibitor, if necessary.

The rust preventing agent includes, for example, fatty acid, fatty acid soap, fatty acid amine, alkylsulfonate, oxidized paraffin, polyoxyalkyl ether, sodium sulfonate, barium sulfonate, potassium sulfonate, calcium sulfonate, alkylnaphthalene, sodium nitrite, sodium nitride and the like. The corrosion inhibitor includes, for example, benztriazole, benzimidazole, thiadiazole and the like.

As a method for preparing the lubricating grease composition of the invention is not restricted in particular, the present composition may be formed, for example, by mixing a predetermined amount of polytetrafluoroethylene and additives to a mixed oil of two kinds of perfluoropolyether and thoroughly kneading them by means of a three-roll or high pressure homogenizer.

Embodiments of the invention are summarized as in the following.

1. A low torque grease composition having dynamic viscosity (40° C.) of 40 to 150 $mm^2$/sec which comprises a base oil consisting of (a) straight-chain perfluoropolyether oil having dynamic viscosity (40° C.) of 25 $mm^2$/sec or less and represented by the following general formula:

$$RfO(CF_2O)_p(C_2F_4O)_q(C_3F_6O)_rRf$$

wherein Rf is a perfluoro lower alkyl group and all of p, q and r is an integer and a sum thereof is an integer of 25 to 45 and (b) straight-chain perfluoropolyether oil having dynamic viscosity (40° C.) of 250 $mm^2$/sec or more and represented by the following general formula:

$$RfO(CF_2O)_p(C_2F_4O)_q(C_3F_6O)_rRf$$

wherein Rf is a perfluoro lower alkyl group and p, q and r are an integer and a sum thereof is an integer of 100 to 200; and (c) polytetrafluoroethylene as a thickener.

2. A low torque grease composition having dynamic viscosity (40° C.) of 40 to 150 $mm^2$/sec described in the above item 1 in which straight-chain perfluoropolyether oils of molecular structure represented by the following general formula:

$$RfO(CF_2O)_p(C_2F_4O)_q(C_3F_6O)_rRf$$

wherein Rf is a perfluoro lower alkyl group, all of p, q and r is an integer, r=0 and a sum of p+q is an integer of 25 to 200, are used as components (a) and (b).

3. A low torque grease composition having dynamic viscosity (40° C.) of 40 to 150 $mm^2$/sec described in the above item 1 or 2 in which a (c) polytetrafluoroethylene thickener comprises (d) particulate component having a particle diameter of 0.5 μm or less in an amount of 5 to 95% by mass and (e) particulate component having a particle diameter of 5 $\mu$m or more in an amount of 95 to 5% by mass.

4. A low torque grease composition having dynamic viscosity (40° C.) of 40 to 150 $mm^2$/sec described in any one of the above items 1 to 3 which comprises a straight-chain perfluoropolyether oil having dynamic viscosity (40° C.) of 40 to 150 $mm^2$/sec in an amount of 20% by mass of total base oil and represented by the following general formula:

$$RfO(CF_2O)_p(C_2F_4O)_q(C_3F_6O)_rRf$$

wherein Rf is a perfluoro lower alkyl group, all of p, q and r is an integer and a sum thereof is an integer of 50 to 80.

5. A low torque grease composition having dynamic viscosity (40° C.) of 40 to 150 $mm^2$/sec described in any one of the above items 1 to 4 in which a rust preventing agent and/or corrosion inhibitor is added.

6. A low torque grease composition having dynamic viscosity (40° C.) of 40 to 150 $mm^2$/sec described in any one of the above items 1 to 4 for the purpose of using for bearings of electric controlling throttle motor of cars.

7. A low torque grease composition having dynamic viscosity (40° C.) of 40 to 150 $mm^2$/sec described in any one of the above items 1 to 4 for the purpose of using for motor bearings of aircraft.

The invention will be further described in detail by the following examples, however it is not restricted by these examples.

Each perfluoropolyether oil used in a base oil and each thickener of the invention are as follows.

(Base Oil)

Perfluoropolyether represented by the general formula:

$$RfO(CF_2CF_2O)_m(CF_2O)_nRf$$

Four kinds of perfluoropolyether components were as in the following:

A-1: dynamic viscosity (40° C.) of 15 $mm^2$/sec; m+n=35

A-2: dynamic viscosity (40° C.) of 70 $mm^2$/sec; m+n=60

A-3: dynamic viscosity (40° C.) of 85 $mm^2$/sec; m+n=70

A4: dynamic viscosity (40° C.) of 320 $mm^2$/sec; m+n=110

Of these perfluoropolyether, A-1 and A-4 were used as components (a) and (b) of the invention, respectively.

(Thickener)

B-1: emulsion polymerized polytetrafluoroethylene (molecular weight of 100,000 to 200,000 and primary particle diameter of 0.2 $\mu$m)

B-2: solution polymerized polytetrafluoroethylene (molecular weight of 100,000 to 200,000 and primary particle diameter of 0.1 $\mu$m)

B-3: suspension polymerized polytetrafluoroethylene (molecular weight of 50,000 to 100,000 and primary particle diameter of 13 $\mu$m)

Of these thickeners, B-1 and/or B-2, were used as components (d) and B-3 were used as components (e) of the invention, respectively.

EXAMPLE 1

A base oil having dynamic viscosity (40° C.) of 45 $mm^2$/sec was prepared by mixing two kinds of perfluoropolyether A-1 as the component (a) and A4 as the component (b) in a mass ratio of 3:1. Polytetrafluoroethylene (B-2) as the thickener was added to the base oil in an amount of 20% by mass of total composition and thoroughly kneaded by means of three-roll to yield a grease composition.

Further, grease compositions of Examples 2 to 13 and Comparative Examples 1 to 3 were prepared in a similar manner as described above. Constituents, compounding ratios, etc. are shown in Table 1 below.

TABLE 1

| Example | base oil constituent viscosity (40° C.) | | | thickener constituent | | thickener ratio (mass %) |
|---|---|---|---|---|---|---|
| Ex. 1 | A-1 | A-4 | 45 | B-2(100) | | 20 |
| Ex. 2 | A-1 | A-4 | 65 | B-2(100) | | 20 |
| Ex. 3 | A-1 | A-4 | 85 | B-2(100) | | 20 |
| Ex. 4 | A-1 | A-4 | 85 | B-1(20) | B-3(80) | 30 |
| Ex. 5 | A-1 | A-4 | 85 | B-1(40) | B-3(60) | 35 |
| Ex. 6 | A-1 | A-4 | 100 | B-1(100) | | 30 |
| Ex. 7 | A-1 | A-4 | 120 | B-1(30) | B-3(70) | 35 |
| Ex. 8 | A-1 | A-4 | 120 | B-2(100) | | 20 |
| Ex. 9 | A-1 | A-4 | 140 | B-1(100) | | 20 |
| Ex. 10 | A-1 | A-4 | 140 | B-1(30) | B-3(70) | 30 |
| Ex. 11 | A-1 | A-4 | 200 | B-2(100) | | 20 |
| Ex. 12 | A-1 | A-4<br>A-2(10) | 70 | B-1(100) | | 20 |
| Ex. 13 | A-1 | A-4<br>A-3(15) | 85 | B-2(100) | | 20 |
| C. Ex. 1 | A-2 | | 70 | B-1(100) | | 35 |
| C. Ex. 2 | A-3 | | 85 | B-2(100) | | 25 |
| C. Ex. 3 | A-3 | | 85 | B-3(100) | | 25 |

Lubricating grease compositions obtained by the above mentioned Examples and comparative examples were subjected to low temperature torque tests as in the following.

(1) Low Temperature Torque Test—1

A deep groove ball bearing with rubber seal of ø 8 mm in inner diameter, ø 22 mm in outer diameter and 7 mm in width was filled with the above mentioned grease so that 30% of a space thereof was occupied by the grease. The bearing was rotated at 1,800 rpm for 10 seconds, allowed to stand for two hours in a constant temperature bath at −40° C. while applying a preload of 20 N and then subjected to torque determination at a inner ring rotating speed of 300 rpm. Further, the maximum torque value within 10 seconds from initial rotation was evaluated as starting torque, while the torque value after 5 minutes from the beginning of determination was also evaluated.

(2) Low Temperature Torque Test—2

A deep groove ball bearing with rubber seal of ø 8 mm in inner diameter, ø 22 mm in outer diameter and 7 mm in width was filled with the above mentioned grease so that 30% of a space thereof was occupied by the grease. The bearing was rotated at 1,800 rpm for 10 seconds, allowed to stand for two hours in a constant temperature bath at −40° C. by pressurizing at 300 N and then subjected to torque determination at a inner ring rotating speed of 300 rpm. Further, the maximum torque value within 10 seconds from initial rotation was evaluated as starting torque, while the torque value after 5 minutes from the beginning of determination was also evaluated.

The result is shown in Table 2.

TABLE 2

| | low temp. torque test - 1 (g-cm) | | low temp. torque test - 2 (g-cm) | |
|---|---|---|---|---|
| Example | starting | after 5 min. | starting | after 5 min. |
| Ex. 1 | 270 | 90 | 700 | 325 |
| Ex. 2 | 300 | 100 | 770 | 320 |

TABLE 2-continued

| Example | low temp. torque test - 1 (g-cm) | | low temp. torque test - 2 (g-cm) | |
|---|---|---|---|---|
| | starting | after 5 min. | starting | after 5 min. |
| Ex. 3 | 380 | 110 | 800 | 320 |
| Ex. 4 | 350 | 80 | 830 | 240 |
| Ex. 5 | 360 | 70 | 850 | 260 |
| Ex. 6 | 400 | 120 | 950 | 500 |
| Ex. 7 | 410 | 80 | 870 | 255 |
| Ex. 8 | 410 | 130 | 900 | 460 |
| Ex. 9 | 420 | 140 | 950 | 350 |
| Ex. 10 | 450 | 90 | 950 | 260 |
| Ex. 11 | 490 | 180 | 990 | 600 |
| Ex. 12 | 520 | 310 | 950 | 750 |
| Ex. 13 | 560 | 310 | 990 | 200 |
| C. Ex. 1 | 670 | 300 | 1100 | 900 |
| C. Ex. 2 | 600 | 360 | 1100 | 180 |
| C. Ex. 3 | 750 | 200 | 1300 | 900 |

It is clear from the result of Table 2 that low torque properties are exhibited even at low temperatures under high load by grease compositions comprising straight-chain perfluoropolyether having high molecular weight and high viscosity and straight-chain perfluoropolyether having low molecular weight and low viscosity, as well as polytetrafluoroethylene as a thickener. In particular, a thickener of polytetrafluoroethylene having different particle diameters is more effective. It is possible to obtain a bearing endowed with low torque properties at low temperatures under high load, which has not been achieved by conventional fluorine grease.

What is claimed is:

1. A low torque grease composition having dynamic viscosity (40° C.) of 40 to 150 $mm^2$/sec which comprises a base oil consisting of (a) straight-chain perfluoropolyether oil having dynamic viscosity (40° C.) of 25 $mm^2$/sec or less and represented by the following general formula:

$$RfO(CF_2O)_p(C_2F_4O)_q(C_3F_6O)_rRf$$

wherein Rf is a perfluoro lower alkyl group and all of p, q and r is an integer and a sum thereof is an integer of 25 to 45 and (b) straight-chain perfluoropolyether oil having dynamic viscosity (40° C.) of 250 $mm^2$/sec or more and represented by the following general formula:

$$RfO(CF_2O)_p(C_2F_4O)_q(C_3F_6O)_rRf$$

wherein Rf is a perfluoro lower alkyl group and p, q and r are an integer and a sum thereof is an integer of 100 to 200; and (c) polytetrafluoroethylene as a thickener.

2. A low torque grease composition having dynamic viscosity (40° C.) of 40 to 150 $mm^2$/sec claimed in claim 1 in which straight-chain perfluoropolyether oils of molecular structure represented by the following general formula:

$$RfO(CF_2O)_p(C_2F_4O)_q(C_3F_6O)_rRf$$

wherein Rf is a perfluoro lower alkyl group, all of p, q and r is an integer, r=0 and a sum of p+q is an integer of 25 to 200, are used as components (a) and (b).

3. A low torque grease composition having dynamic viscosity (40° C.) of 40 to 150 $mm^2$/sec claimed in claim 1 wherein (c) a polytetrafluoroethylene thickener comprises (d) particulate component having a particle diameter of 0.5 $\mu$m or less in an amount of 5 to 95% by mass and (e) particulate component having a particle diameter of 5 $\mu$m or more in an amount of 95 to 5% by mass.

4. A low torque grease composition having dynamic viscosity (40° C.) of 40 to 150 $mm^2$/sec claimed in claim 1 which comprises a straight-chain perfluoropolyether oil having dynamic viscosity (40° C.) of 40 to 150 $mm^2$/sec in an amount of 20% or less by mass of total base oil and represented by the following general formula:

$$RfO(CF_2O)_p(C_2F_4O)_q(C_3F_6O)_rRf$$

wherein Rf is a perfluoro lower alkyl group, all of p, q and r is an integer and a sum thereof is an integer of 50 to 80.

5. A low torque grease composition having dynamic viscosity (40° C.) of 40 to 150 $mm^2$/sec claimed in claim 1 in which a rust preventing agent and/or corrosion inhibitor is added.

6. A low torque grease composition having dynamic viscosity (40° C.) of 40 to 150 $mm^2$/sec claimed in claim 1 for the purpose of using for bearings of electric controlling throttle motor of cars.

7. A low torque grease composition having dynamic viscosity (40° C.) of 40 to 150 $mm^2$/sec claimed in claim 1 for the purpose of using for motor bearings of aircraft.

8. A low torque grease composition having dynamic viscosity (40° C.) of 40 to 150 $mm^2$/sec claimed in claim 2 wherein (c) a polytetrafluoroethylene thickener comprises (d) particulate component having a particle diameter of 0.5 $\mu$m or less in an amount of 5 to 95% by mass and (e) particulate component having a particle diameter of 5 $\mu$m or more in an amount of 95 to 5% by mass.

9. A low torque grease composition having dynamic viscosity (40° C.) of 40 to 150 $mm^2$/sec claimed in claim 2 which comprises a straight-chain perfluoropolyether oil having dynamic viscosity (40° C.) of 40 to 150 $mm^2$/sec in an amount of 20% or less by mass of total base oil and represented by the following general formula:

$$RfO\ (CF_2O)_p(C_2F_4O)_q(C_3F_6O)_rRf$$

wherein Rf is a perfluoro lower alkyl group, all of p, q and r is an integer and a sum thereof is an integer of 50 to 80.

10. A low torque grease composition having dynamic viscosity (40° C.) of 40 to 150 $mm^2$/sec claimed in claim 2 in which a rust preventing agent and/or corrosion inhibitor is added.

11. A low torque grease composition having dynamic viscosity (40° C.) of 40 to 150 $mm^2$/sec claimed in claim 2 for the purpose of using for bearings of electric controlling throttle motor of cars.

12. A low torque grease composition having dynamic viscosity (40° C.) of 40 to 150 $mm^2$/sec claimed in claim 2 for the purpose of using for motor bearings of aircraft.

13. A low torque grease composition having dynamic viscosity (40° C.) of 40 to 150 $mm^2$/sec claimed in claim 3 which comprises a straight-chain perfluoropolyether oil having dynamic viscosity (40° C.) of 40 to 150 $mm^2$/sec in an amount of 20% or less by mass of total base oil and represented by the following general formula:

$$RfO(CF_2O)_p(C_2F_4O)_q(C_3F_6O)_rRf$$

wherein Rf is a perfluoro lower alkyl group, all of p, q and r is an integer and a sum thereof is an integer of 50 to 80.

14. A low torque grease composition having dynamic viscosity (40° C.) of 40 to 150 $mm^2$/sec claimed in claim 13 in which a rust preventing agent and/or corrosion inhibitor is added.

15. A low torque grease composition having dynamic viscosity (40° C.) of 40 to 150 $mm^2$/sec claimed in claim 13 for the purpose of using for bearings of electric controlling throttle motor of cars.

16. A low torque grease composition having dynamic viscosity (40° C.) of 40 to 150 $mm^2$/sec claimed in claim 13 for the purpose of using for motor bearings of aircraft.

* * * * *